US007775302B2

(12) United States Patent
Warren

(10) Patent No.: US 7,775,302 B2
(45) Date of Patent: Aug. 17, 2010

(54) CASING SHOE AND RETRIEVABLE BIT ASSEMBLY

(75) Inventor: Tommy M. Warren, Coweta, OK (US)

(73) Assignee: Tesco Corporation, Houston, TX (US)

( * ) Notice: Subject to any disclaimer, the term of this patent is extended or adjusted under 35 U.S.C. 154(b) by 21 days.

(21) Appl. No.: 12/184,675

(22) Filed: Aug. 1, 2008

(65) Prior Publication Data

US 2010/0025120 A1 Feb. 4, 2010

(51) Int. Cl.
*E21B 10/66* (2006.01)
*E21B 10/32* (2006.01)
*E21B 17/14* (2006.01)

(52) U.S. Cl. ..... 175/260; 175/171; 175/257; 175/268; 175/402

(58) Field of Classification Search ..... 175/257–262, 175/171, 267, 268, 270, 402
See application file for complete search history.

(56) References Cited

U.S. PATENT DOCUMENTS 1,025,339 A 5/1912 Tucker
1,832,129 A 11/1931 Knaur
1,978,119 A 10/1934 Walker
2,239,996 A * 4/1941 Chappell ..... 175/261
3,554,304 A 1/1971 Link et al.
3,880,247 A 4/1975 Harding
4,651,837 A 3/1987 Mayfield
5,271,472 A 12/1993 Leturno
5,957,225 A 9/1999 Sinor
6,454,024 B1 9/2002 Nackerud
6,668,949 B1 * 12/2003 Rives ..... 175/269

OTHER PUBLICATIONS

U.S. Appl. No. 10/906,200, filed Feb. 8, 2005, Hughes.

* cited by examiner

*Primary Examiner*—Giovanna C Wright
(74) *Attorney, Agent, or Firm*—Bracewell & Giuliani LLP

(57) ABSTRACT

An earth boring bit assembly has a tubular mandrel carried by a casing shoe at the lower end of a string of casing. The casing shoe has stabilizer blades spaced circumferentially apart from each other. A cutter arm seat is formed on the leading edge of each blade at a lower end of the casing shoe. Windows are formed in and spaced circumferentially around the mandrel. A cutter arm is pivotally mounted within each window of the mandrel and movable from an extended position located within one of the cutter arm seats to a recessed position within its window. The cutter arm seats support the cutter arms for torque and axial weight. A sleeve inside the mandrel prevents the cutter arms from pivoting to a recessed position until the sleeve is moved to a released position.

19 Claims, 4 Drawing Sheets

CASING SHOE AND RETRIEVABLE BIT ASSEMBLY

FIELD INVENTION

This invention relates in general to drilling oil and gas wells by a casing-while-drilling technique, and particular a bit assembly having pivotal arms supported by stabilizer blades of a casing shoe at the lower end of the casing string.

BACKGROUND OF THE INVENTION

Most oil and gas wells are drilled with drill pipe. After reaching a selected depth, the operator makes up and lowers a string of casing into the well and cements it in place. In another technique, the casing is employed as the drill string while drilling the well. In this technique, a bit and a reamer are located at the lower end of the casing. The drilling rig rotates the string of casing, the drill bit, and the reamer. Drilling fluid is pumped down the casing, which discharges out the bit and flows back up the annulus surrounding the casing. A mud motor can be incorporated with the drill bit and reamer for rotating the drill bit and reamer relative to the casing in response to drilling fluid pumped down the string of casing.

When reaching a desired depth, the operator optionally may cement the drill bit assembly in place. If the well is at total depth, the operator then completes the well by normally running a string of production tubing inside the casing. The operator may also retrieve the drill bit assembly whether or not the casing string is at total depth. If not at total depth, the operator may rerun the drill bit assembly with a new bit or other components of the bottom hole assembly. Retrieving the bottom hole assembly may be done in different manners: with a wire line; circulating drilling fluid from the casing annulus up the string of casing to pump the drill bit assembly up to the surface; and running a string of drill pipe into the string of casing.

If the casing string is at a desired depth and additional casing strings are planned, another technique known in the prior art is to use a bit assembly wherein the center portion is retrievable and the outer portion remains secured to the exterior of the casing shoe and is cemented in the well. A disadvantage is that the outer portion may have expensive cutting and wear resistant elements, such as diamond or tungsten carbide cutting elements, that could be reused. This disadvantage also results wherein the entire cutting structure, including the drill bit and reamer, remains attached to the string of casing and is drilled through after the casing string has been cemented in place.

Another technique is to use pivotal reamer arms on the bit assembly. The reamer arms contain cutting elements for cutting the outer portion of the wellbore. The reamer arms are normally located some distance below the casing shoe attached to the lower end of the string of casing. In that instance, all of the cutting structure is retrieved. Alternately, pivotal reamer arms that are located in slots of the casing shoe are known.

While these various techniques are workable, making a retrievable bit assembly simpler, easier to retrieve, and less expensive would be desirable. These qualities would be particularly advantageous when drilling an upper portion of the well with a string of casing, referred to as surface casing, which often can be done without having to change-out the drill bit.

SUMMARY

The earth boring bit assembly disclosed herein includes a casing shoe that is secured to the lower end of the string of casing. The casing shoe has stabilizer blades that are spaced circumferentially apart from each other, defining a recessed flute between each of the blades. Each of the blades has a leading and a trailing edge considering the direction of rotation of the casing shoe. Each of the blades has a cutter arm seat formed on its leading edge at a lower end of the casing shoe. A tubular mandrel has an upper portion that is carried within the casing shoe and a threaded lower end below the casing shoe that attaches to a pilot bit.

Cutter arms are pivotally mounted to the mandrel and movable from an extended position located within one of the cutter arm seats to a recessed position. Each of the cutter arms has cutting elements mounted on a leading side of the cutter arm. Each of the flutes has an opening at and extending forward from the cutter arm so as to reduce accumulation of cuttings in front of the cutting elements. Each of the seats preferably has a back wall facing in a forward direction and a top wall facing downward. Each of the cutter arms has a mating back surface that mates with the back wall and a top surface that mates with the top wall. Torque applied to the string of casing is transmitted from the seat back wall to the cutter arm. A portion of the weight of the casing is transmitted from the seat top wall to the top surface of the cutter arm.

Each cutter arm is preferably pivotally mounted within a window formed in the mandrel. A sleeve is mounted within a bore of the mandrel. The sleeve has a set position wherein it blocks the cutter arms from pivoting away from the cutter arm seats. The sleeve is movable from the set position to a released position that enables the cutter arms to pivot to the released position. In one embodiment, the sleeve has an exterior surface containing slots, one for each of the cutter arms. Each slot is a recess with a depth less than a wall thickness of the sleeve. While the sleeve is in the set position the slots are misaligned with the cutter arms. When the sleeve is moved to the released position, the slots align with the cutter arms.

Preferably, seals are mounted on the exterior of the sleeve above and below the slots and in sealing engagement with the inner surface of the mandrel while the sleeve is in the set position. The seals prevent drilling fluid from entering the slots while the sleeve is in the set position.

DETAILED DESCRIPTION OF INVENTION

Figure 1:
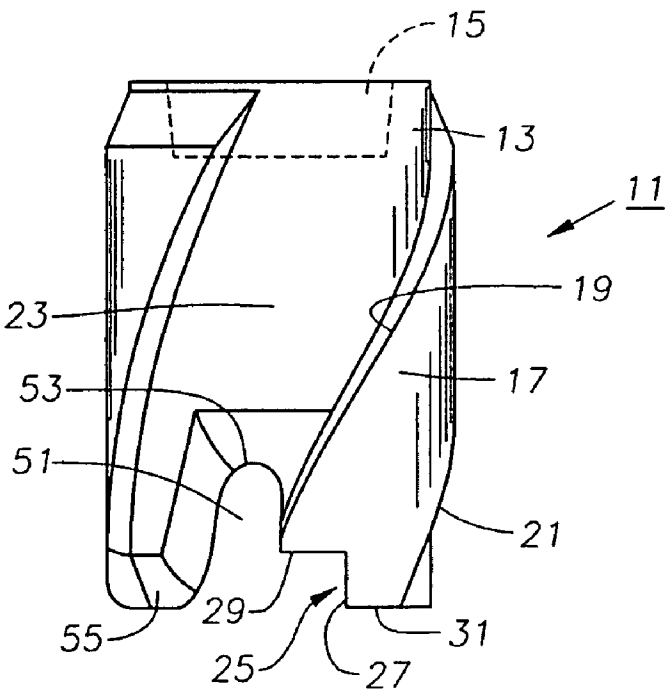
FIG. 1 is a side elevation view of a casing shoe constructed in accordance with one embodiment of this invention.

Referring to FIG. 1, casing shoe 11 comprises a tubular body 13 having a threaded upper end 15 for securing to a lower end of a string of casing (not shown). Casing shoe 11 has a plurality of stabilizer blades 17 formed on its exterior. Each stabilizer blade 17 is a band extending from the lower edge of casing shoe 11 upward a selected distance. The number of stabilizer blades 17 may vary, and in this embodiment three stabilizer blades 17 are utilized. Stabilizer blades 17 protrude out from the exterior of tubular body 13 and may contain hard facing or other hard materials to resist abrasive wear.

Each stabilizer blade 17 has a leading edge 19 and a trailing edge 21. Preferably leading edge 19 and trailing edge 21 are generally parallel. In this example, leading edge 19 and trailing edge 21 incline relative to a longitudinal axis of tubular body 13. The inclination results in a generally helical configuration for stabilizer blades 17.

The spaces or flutes 23 between each stabilizer blade 17 are recessed to approximately the same diameter as the portion of casing shoe 11 above stabilizer blades 17, typically the outer diameter of the casing string. Each flute 23 has a circumferential width that is the same as the circumferential distance between one stabilizer blade leading edge 19 and the adjacent stabilizer blade trailing edge 21. The wall thickness through each stabilizer blade 17 from bore 65 (FIG. 6) of body 13 to the outer side of blade 17 is considerably thicker than the wall thickness through each flute 23. The wall thickness through each stabilizer blade 17 is less than the width of each blade 17. Stabilizer blades 17 may be integrally formed on body 13 of casing shoe 11 by machining away a portion of the body to form flutes 23. Alternately, stabilizer blades 17 may be fabricated separately and attached, as by welding.

A cutter arm seat or support 25 is formed at the lower leading edge 19 of each stabilizer blade 17. Each cutter arm seat 25 comprises a back wall 27 that is recessed in a rotationally rearward direction from the leading edge 19. Back wall 27 is shown to be generally parallel to the axis of tubular body 13 but it could differ. Each cutter arm seat 25 also has a top wall 29 that faces downward. In this example, top wall 29 is about a 70 degree angle relative to back wall 27, but that angle could differ. Top wall 29 extends circumferentially from back wall 27 to leading edge 19 of each stabilizer blade 17 and inclines slightly downward in a forward rotational direction. Also, FIG. 1 illustrates the lower edge 31 of each stabilizer blade 17 as inclining slightly downward, parallel with top wall 29, but that portion, too, could differ. For example both top wall 29 and lower edge 31 could be perpendicular to the axis of tubular body 13.

Figure 2:
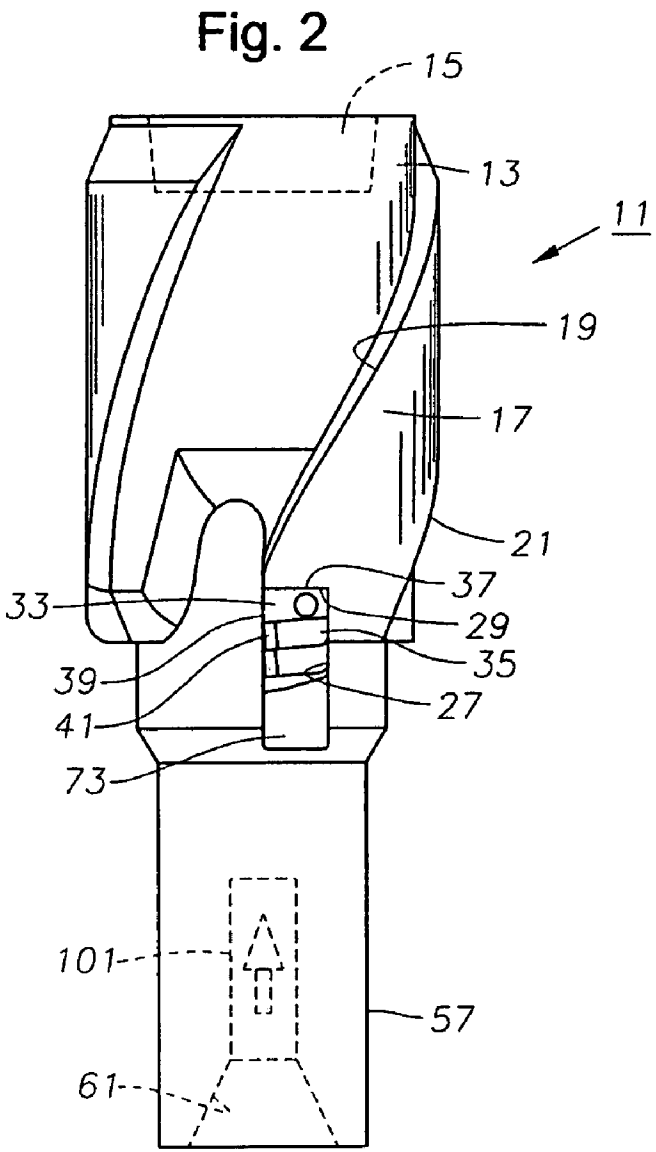
FIG. 2 is a side view of the casing shoe of FIG. 1, and showing a mandrel with cutter arms installed therein.

Referring to FIG. 2, a cutter arm 33 locates within each cutter arm seat 25. As will be explained subsequently, each cutter arm 33 is pivotal and locates in one of the seats 25 when in a set position. Each cutter arm 33 has a back surface 35 that abuts and mates with cutter arm seat back wall 27. Each cutter arm 33 has a top surface 37 that abuts and mates with cutter arm seat top wall 29. Each cutter arm 33 has a forward surface 39 that is substantially flush with the lower portion of stabilizer blade leading edge 19. The less than 90 degree angle between back wall 27 and top wall 29 causes them to grip cutter arm 33 when a downward drilling force is applied. This acute angle minimizes chatter, fretting, and wear due to vibration of cutter arm 33. No structure on casing shoe 11 appears in front of the arm forward surface 39, which otherwise would tend to trap drilled solids.

A plurality of cutting elements 41 are located on forward surface 39 of cutter arm 33. Cutting elements 41 may be a variety of types, such as diamond, tungsten carbide and the like. Also, abrasion resistant elements or hardfacing may be located on the outer surface of cutter arm 33, which is substantially flush with the outer surface of stabilizer blade 17.

Figure 3:
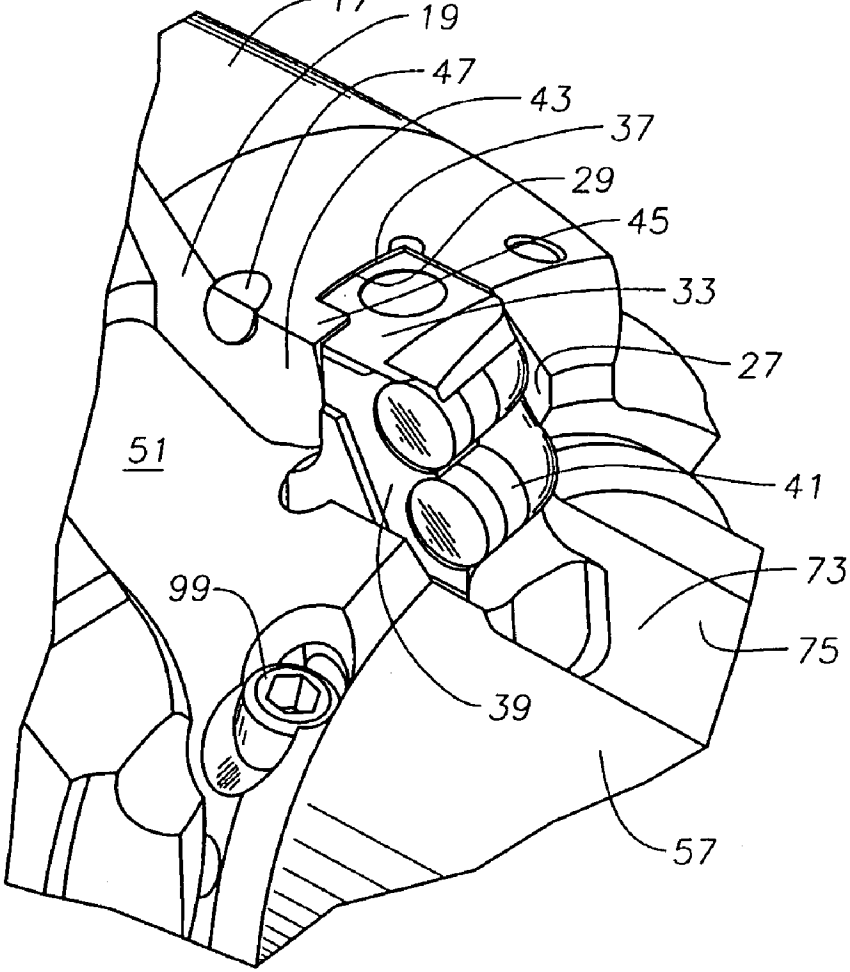
FIG. 3 is a partial isometric view illustrating part of one of the cutter arms of FIG. 2.

Referring to FIG. 3, in this example, a lower portion 43 of the leading edge 19 of each stabilizer arm 17 is flush with cutter arm forward surface 39 and in a plane generally parallel with the axis of tubular body 13. Lower portion 43 extends upward a short distance and joins the remaining portion of leading edge 19, which is helically inclined. An abrasion resisting element 47 may be located at the junction between lower portion 43 and the remaining part of leading edge 19. The length of lower portion 43 may vary, but in this example, it is less than the length of back wall 27 of cutter arms seat 25.

Also, as illustrated in FIG. 3, a lip 45 is formed on the forward edge of seat top wall 29. Lip 45 is generally rectangular in this embodiment. Cutter arm 33 has a mating recess at the junction of top surface 37 with forward surface 39 to mate with lip 45.

Figure 4:
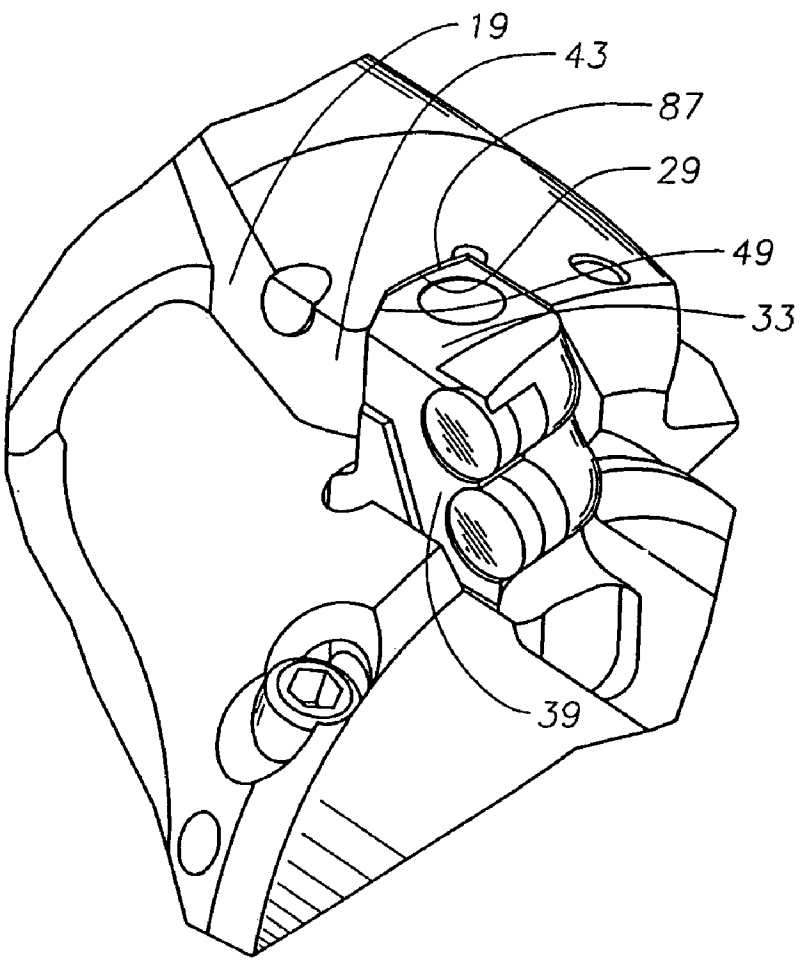
FIG. 4 is an isometric view similar to FIG. 3, but illustrating a different embodiment of a cutter arm.

Referring to FIG. 4, the structure is the same as in FIG. 3, except that lip 49 comprises an inclined or beveled surface, rather than forming a 90 degree corner as lip 45 of FIG. 3. Also, in FIG. 4, lower portion 43 of leading edge 19 is slightly smaller in axial length.

Figure 5:
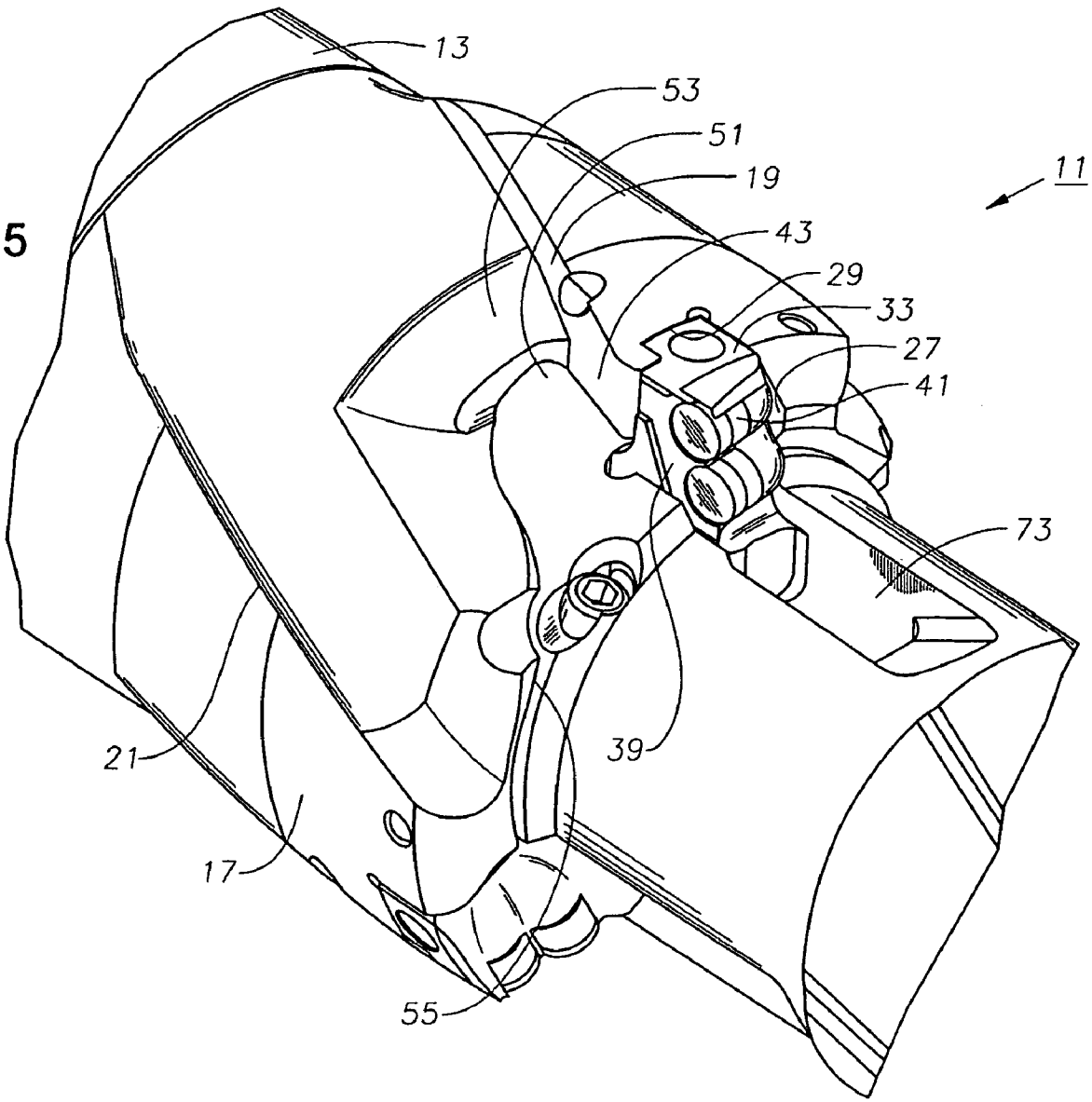
FIG. 5 is a view similar to FIGS. 3 and 4, but illustrating a still different embodiment of one of the cutter arms.

Referring now to FIG. 5, the structure shows a lip 45 that is identical to lip 45 of FIG. 3. The difference between the structure in FIG. 5 and in FIG. 3 is that the lower edge portion 43 of leading edge 19 is much smaller in axial length than lower portion 43 of FIG. 3. The inclined portion of leading edge 19 thus begins approximately at cutter arm seat 25.

Referring still to FIG. 5, a flute opening 51 is formed in each flute 23. Flute opening 51 is located at the lower edge of each flute 23 and extends to bore 65 (FIG. 6) of body 13. Flute opening 51 begins at stabilizer blade leading edge 19 and extends in a forward direction toward the next stabilizer blade 17. The circumferential width of flute opening 51 is variable, but is shown to be approximately ⅓ to ½ the circumferential width of flute 23. The height of flute opening 51 is also variable, but in this instance the height of opening 51 along leading edge 19 is greater than the height of back wall 27 of cutter arm seat 25. Flute opening 51 is thus defined by a flute rearward lower edge portion 53 and a flute forward lower edge portion 55. Flute forward lower edge portion 55 is located at the lower end of casing shoe 11, while flute rearward lower edge portion 53 is spaced above cutter arm seat 25. Edge portions 53 and 55, as well as the transitional edge portion of opening 51 that joins edge portions 53 and 55, are preferably tapered. Flute openings 51 remove any obstructing structure in front of cutting elements 41 so as to avoid bit balling or the accumulation of earth formation such as shale.

The various shapes of leading edge 19 shown in FIGS. 3, 4 and 5 and the shape of flute opening 51 are selected to minimize the packing of drilling debris on the casing shoe 11. The configurations reduce packing without impairing drilling performance or the recovery of inner components of casing shoe 11 after drilling has been completed.

Figure 6:
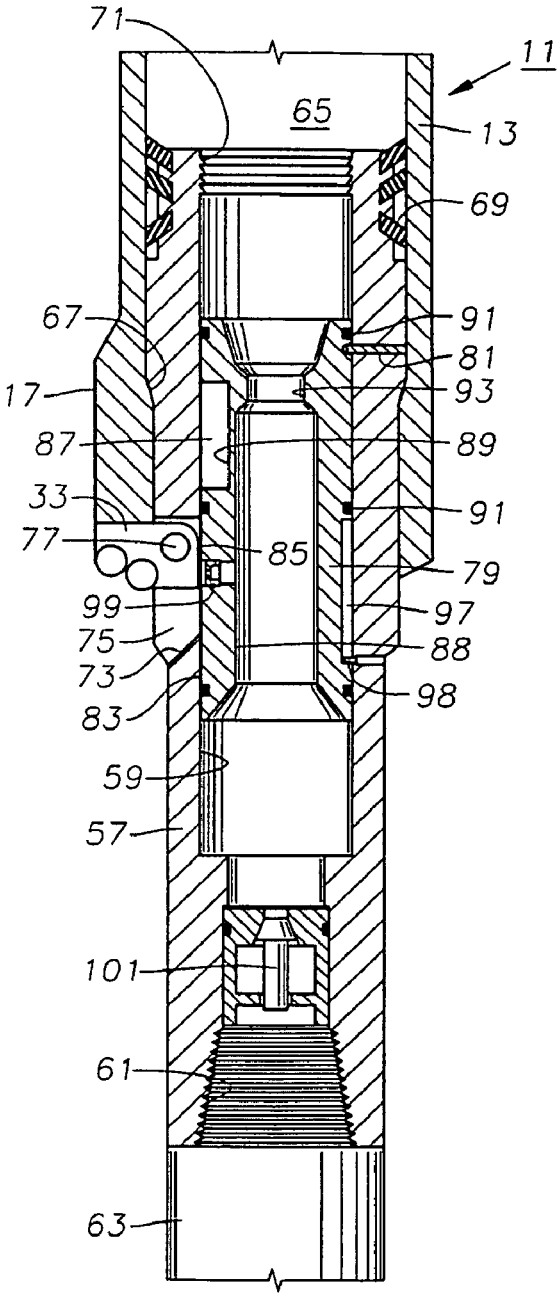
FIG. 6 is a vertical sectional view of the casing shoe and mandrel shown in FIG. 2.
Figure 7:
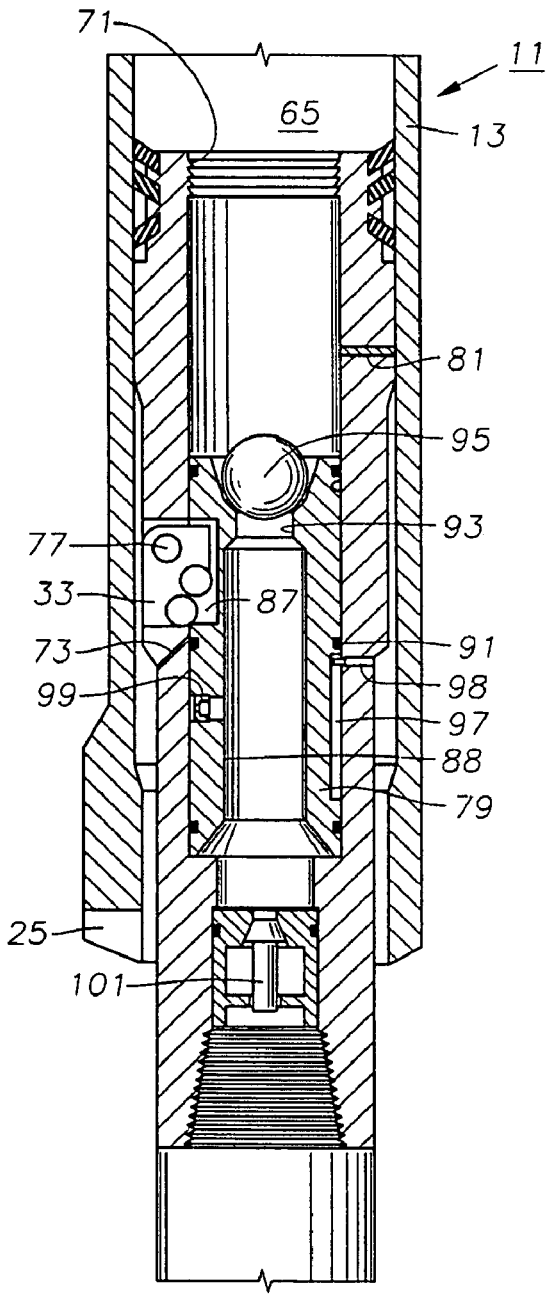
FIG. 7 is a vertical sectional view similar to FIG. 6, but showing the cutter arm retracted.

Referring now to FIGS. 6 and 7, cutter arms 33 are mounted to a mandrel 57, which is a tubular member having an axial passage 59 extending there through. Mandrel 57 has a threaded lower end 61 for securing to a pilot bit 63. Another tubular member may optionally be located between mandrel 57 and pilot bit 63. Mandrel 57 is closely received inside of casing shoe bore 65. Casing shoe bore 65 has an inward facing shoulder 67, and an enlarged upper portion of mandrel 57 lands on shoulder 67, preventing it from any further downward movement. In this embodiment, mandrel 57 has seals 69 on its exterior, preferably near its upper end. Seals 69 engage casing shoe bore 65 and are arranged to seal against both upward flowing fluid as well as downward flowing fluid in this example. Also, a grapple profile 71 is schematically shown formed on the inner diameter of mandrel passage 59 near the upper end. Grapple profile 71 is configured to be engaged by a retrieving tool lowered from the surface on wireline or drill pipe for pulling mandrel 57 out of casing shoe 11 and the string of casing.

Mandrel 57 has a plurality of windows 73 formed therein, one for each cutter arm 33. Each window 73 is an elongated opening extending from passage 59 to the exterior of mandrel 57. Each window 73 is a narrow aperture having parallel flat side walls 75 that extend axially. Side walls 75 are opposed to each other. A pivot pin 77 is fastened into each side wall 75 near the upper end of window 73. Pivot pin 77 extends through an opening in cutter arm 33 to allow cutter arm 33 to pivot between the extended position shown in FIG. 6 and the retracted position shown in FIG. 7.

A sleeve 79 is carried within mandrel bore 59 in a set position in FIG. 6 and a released position in FIG. 7. Sleeve 79 is secured in the set position by one or more shear pins 81 that releasably secure sleeve 79 to mandrel 57. Sleeve 79 has a lower exterior surface 83 that is closely spaced or in contact with mandrel bore 59. Cutter arm 33 has a support end 85 that contacts sleeve exterior surface 83 while sleeve 79 is in the set position of FIG. 6. Cutter arm support end 85 prevents cutter arm 33 from pivoting counterclockwise to the recessed position because of its abutment with sleeve exterior surface 83. Support end 85 is oriented generally axially while in the extended position of FIG. 6 and generally in a plane perpendicular to the axis while in the retracted position of FIG. 7.

Slots 87 are formed in the exterior surface of sleeve 79 above lower exterior surface 83. Slots 87 are elongated, thin cavities that do not extend the full thickness of sleeve 79. Rather, each has a base 89 that faces outward and separates slot 87 from sleeve bore 88. Slots 87 are circumferentially spaced apart so that each will receive one of the cutter arms 33 while in the released position shown in FIG. 7. Preferably, annular seals 91 are located both above and below slots 87. Seals 91 seal to mandrel bore 59, preventing entry of drilling fluid into slots 87 while sleeve 79 is in the set position of FIG. 6. Seals 91 assure clean slots 87 for cutter arms 33 to retract into when sleeve 79 is moved downward to release mandrel 57. If slots 87 were exposed to drilling fluid while bit 63 is drilling, cuttings could pack into slots 87 and prevent cutter arms 33 from retracting.

In this embodiment, sleeve 79 is moved from the set to the released position by applying fluid pressure from the string of casing. A pressure seat 93 is formed in sleeve bore 88. An object, such as a dart or ball 95 (FIG. 7) is dropped or pumped down the string of casing from the surface. When ball 95 lands on seat 93, it seals bore 88. Pressure applied in the string of casing from above will exert a force on sleeve 79 that causes shear pin 81 to shear. Sleeve 79 will then move to the lower released position.

Sleeve 79 preferably has an anti-rotation key 97 that mates with the mating slot in mandrel bore 59 to prevent sleeve 79 from rotating. During installation, sleeve 79 will be oriented so that slots 87 are located directly above cutter arms 33. A nozzle 99 for each cutter arm 33 may be located within sleeve 79. Each nozzle 99 extends from sleeve bore 88 to window 73 while sleeve 79 is in the set position. As illustrated in FIGS. 3-5, each nozzle 99 is positioned to spray drilling fluid directly in front of and on to cutting elements 41.

The assembly may also include a drilling check valve 101. In this example, check valve 101 is located near the lower end of mandrel passage 59. Check valve 101 allows fluid to be pumped down through drill bit 63 but prevents fluid from flowing back up through mandrel passage 59.

In operation, referring to FIG. 2, mandrel 57 will be installed within casing shoe 11 while at the surface. After installation, cutter arms 33 will be in the extended position shown in FIGS. 2-6. Sleeve 79 (FIG. 6) will be in the set position, preventing cutter arms 33 from pivoting to the recessed position of FIG. 7. The operator attaches pilot bit 63 (FIG. 6) to mandrel 57, and attaches casing shoe 11 to the lower end of a string of casing (not shown). The term "casing" is used herein broadly to include other tubulars that may be cemented in a well, such as liners. The operator drills by rotating the casing and casing shoe 11. Referring to FIG. 2, stabilizer arm back wall 27 transmits torque to cutter arm 33 to cause it to ream the bore hole. The weight of the string of casing transfers through top wall 29 to cutter arm 33. The downward force on cutter arms 33 transfers directly to a portion of the wellbore and also down mandrel 57 to pilot bit 63. Mandrel 57 is prevented from moving upward in casing shoe 11 by the engagement of cutter arms 33 with top walls 29 (FIG. 1) of casing shoe seats 25. Sleeve 79 prevents cutter arms 33 from pivoting into the recessed position.

When reaching the total depth, in one embodiment, the operator then drops ball 95 as illustrated in FIG. 7. After, ball 95 lands on seat 93, the operator increases fluid pressure within the casing string, which causes shear pin 81 to shear, pushing sleeve 79 to the released position of FIG. 7. While doing so, slots 87 on sleeve 79 will register with cutter arms 33, allowing cutter arms 33 to pivot into the recessed position of FIG. 7. The operator then may retrieve mandrel 57 and cutter arms 33. This procedure may be done by lowering a wire line with a grapple into engagement with grapple profile 71 and retrieving the assembly. Alternately, the operator may initiate reverse circulation, which causes drilling mud in the casing annulus to flow down the annulus surrounding the string of casing and upward into the interior of the string of casing. This upward flowing fluid exerts an upward force on mandrel 57, causing it to advance upward in the casing string to the surface.

The operator may then lower a cement valve (not shown) down the casing string, which may land on landing shoulder 67 (FIG. 6). The cement valve could be run in by pumping downward in the casing string, by running it on wireline, or by a conduit such as drill pipe. The operator would then cement the casing string and casing shoe in place. The cement valve allows the downward flow of cement in the casing but prevents cement from returning from the casing annulus back up the interior of the casing. Unless at total depth, the operator would then normally lower another drill string through the now cemented string of casing and commence drilling deeper. That could be handled by casing-while-drilling techniques or by drilling with drill pipe.

The drill bit assembly is simple in construction and robust. The support provided by the stabilizer blades to the pivotal cutter arms allows a relatively light pivot mechanism to be employed. The seats and mating cutter arms transmit both torsional as well as axial loads to the cutter arms. The openings in the lower ends of the flutes reduce the chance of bit balling due to sticky shale formations being drilled. The drill bit assembly is particularly useful for installing casing strings, such as surface casing, where the drill bit is capable of drilling the entire depth of the casing string.

While the invention has been shown in only a few of its forms, it should be apparent to those skilled in the art that it is not so limited but is susceptible to various changes without departing from the scope of the invention.

The invention claimed is:

1. An earth boring bit assembly for casing-while-drilling, comprising:

a casing shoe adapted to be secured to a lower end of a string of casing, the casing shoe having a plurality of stabilizer blades spaced circumferentially apart from each other, defining a recessed flute between each of the blades;

each of the blades having a leading edge and a trailing edge considering a direction of rotation of the casing shoe;

a cutter arm seat formed on the leading edge of each blade at a lower end of the casing shoe;

a tubular mandrel having an upper portion carried within the casing shoe and a threaded lower end below the casing shoe for threaded engagement with a pilot bit;

a plurality of cutter arms pivotally mounted to the mandrel and movable from an extended position located within one of the cutter arm seats to a recessed position, each of the cutter arms having a plurality of cutting elements mounted on a leading side of the cutter arm; and each of the flutes defining an opening at and extending forward from the cutting elements so as to reduce accumulation of cuttings in front of the cutting elements.

2. The bit assembly according to claim 1, wherein each of the openings is defined by a lower edge portion of each of the flutes, the lower edge portion being located above the cutting elements and tapered.

3. The bit assembly according to claim 2, wherein each of the lower edge portions extends in a forward direction from the leading edge of one of the stabilizer blades a distance that is less than a width of each of the flutes.

4. The bit assembly according to claim 1, wherein the leading and trailing edges of the stabilizer blades have upper portions that are inclined relative to an axis of the casing shoe.

5. The bit assembly according to claim 1, wherein each of the cutter arm seats comprises:

a back wall facing in a forward direction and a downward facing top wall extending forward from the back wall to the leading edge of one of the stabilizer blades, and wherein each of the cutter arms engages the back wall and the top wall, so that torque applied to the string of casing is transmitted from the back walls to the cutter arms and weight of the string of casing is transmitted from the top walls to the cutter arms.

6. The bit assembly according to claim 1, wherein each of the cutter arms is mounted within a window formed in the mandrel.

7. The bit assembly according to claim 1, further comprising:

a sleeve mounted within a bore of the mandrel, the sleeve having a set position wherein it blocks the cutter arms from pivoting away from the cutter arm seats, the sleeve being movable from the set position to a released position that enables the cutter arms to pivot to the recessed position.

8. The bit assembly according to claim 7, wherein:

the sleeve has an exterior surface containing a plurality of slots, one for each of the cutter arms, each of the slots having a depth less than a wall thickness of the sleeve;

while the sleeve is in the set position, the slots are misaligned with the cutter arms; and while in the released position, the slots align with the cutter arms.

9. The bit assembly according to claim 8, further comprising seals mounted on the exterior of the sleeve above and below the slots and in sealing engagement with the bore of the mandrel while the sleeve is in the set position, to prevent drilling fluid from entry into the slots while the sleeve is in the set position.

10. The bit assembly according to claim 7, further comprising:

a pressure seat formed on the sleeve for sealing engagement with an object pumped down the string of casing, so that fluid pressure applied to the object after engaging the pressure seat causes the sleeve to move downward from the set position to the released position.

11. An earth boring bit assembly for casing-while-drilling, comprising:

a tubular mandrel adapted to be carried at a lower end of a string of casing;

a plurality of windows formed in and spaced circumferentially around the mandrel;

a cutter arm pivotally mounted within each window and movable from an extended position protruding from its window to a recessed position flush with its window, each of the cutter arms having a plurality of cutting elements mounted on a leading side of the cutter arm;

a sleeve mounted in a bore of the mandrel, the sleeve having a plurality of slots formed in an exterior surface of the sleeve and spaced circumferentially-apart from each other, each of the slots having a depth less than a wall thickness of the sleeve;

the sleeve being movable from an upper set position wherein the exterior of the sleeve prevents the cutter arms from pivoting inward, the sleeve being movable to a lower released position, wherein the slots align with the cutter arms to allow the cutter arms to pivot inward; and annular seals extending around the exterior of the sleeve above and below the slots and in sealing engagement with the bore of the mandrel while the sleeve is in the set position to prevent entry of drilling fluid into the slots.

12. The bit assembly according to claim 11, further comprising a seat formed on the sleeve for sealing engagement with an object pumped down the string of casing, such that fluid pressure against the object when seated moves the sleeve to the lower position.

13. The bit assembly according to claim 11, wherein:

each of the windows has axially extending sidewalls, relative to an axis of the mandrel; and a pivot pin extends between the sidewalls of each of the windows and through an end portion of one of the cutter arms.

14. The bit assembly according to claim 11, further comprising:

a casing shoe adapted to be secured to a lower end of a string of casing, the casing shoe having a plurality of stabilizer blades spaced circumferentially apart from each other;

a cutter arm seat formed on the leading edge of each blade at a lower end of the casing shoe, each cutter arm seat having a back wall facing forward and a top wall facing downward;

each of the cutter arms has a back surface that mates with one of the back walls to receive torque imposed on the casing shoe; and each of the cutter arms has an upper surface that mates with one of the top walls to receive weight imposed on the casing shoe.

15. The bit assembly according to claim 14, wherein:

a flute having an outward facing surface extends between and is recessed from each of the stabilizer blades; and each of the flutes has a lower edge portion that terminates above and forward of one of the cutter arm seats.

16. An earth boring bit assembly for casing-while-drilling, comprising:

a casing shoe adapted to be secured to a lower end of a string of casing, the casing shoe having a plurality of stabilizer blades spaced circumferentially apart from each other;

each of the blades having a leading edge and a trailing edge considering a direction of rotation of the casing shoe;

a cutter arm seat formed on the leading edge of each blade at a lower end of the casing shoe, each cutter arm scat having a back wall facing into a direction of rotation of the casing shoe, and each of the cutter arm seats having an upper wall extending forward from the back wall to the leading edge of one of the blades;

a tubular mandrel having an upper portion carried within the casing shoe and a threaded lower end below the casing shoe for threaded engagement with a pilot bit;

a plurality of windows formed in and spaced circumferentially around the mandrel;

a cutter arm pivotally mounted within each window of the mandrel and movable from an extended position located within one of the cutter arm seats to a recessed position within its window, each of the cutter arms having a plurality of cutting elements mounted on a leading side of the cutter arm;

each cutter arm having a back surface that mates with the back wall of one of the stabilizer blades and a top surface that mates with the top wall of one of the stabilizer blades while in the extended position; wherein the leading and trailing edges of each of the stabilizer blades have upper portions that are inclined relative to an axis of the casing shoe; and the leading sides of the cutter arms are substantially flush with a lower portion of the leading edge of its stabilizer blade.

17. The bit assembly according to claim 16, wherein:

the top wall of each of the cutter arm seats has a downward protruding lip at the leading edge of its stabilizer blade; and the top surface of each of the cutter arms has a mating recess on a forward edge that mates with the lip.

18. The bit assembly according to claim 16, wherein:

each of the windows has axially extending sidewalls, relative to an axis of the mandrel; and a pivot pin extends between the sidewalls of each of the windows and through an end portion of one of the cutter arms.

19. The bit according to claim 16, further comprising:

a sleeve carried within a bore of the mandrel, the sleeve having a set position wherein an exterior surface of the sleeve blocks each window to prevent the cutter arms from pivoting to the recessed position; and the sleeve having a released position wherein its exterior surface is spaced axially from the windows relative to an axis of the mandrel, enabling the cutter arms to pivot to the retracted position.

* * * * *